US008246425B2

(12) United States Patent
Schudel

(10) Patent No.: US 8,246,425 B2
(45) Date of Patent: Aug. 21, 2012

(54) ABRASIVE WHEEL COMPRISING A FAN-LIKE STRUCTURE

(75) Inventor: Werner Schudel, Schwyz (CH)

(73) Assignee: J. Walter Company Ltd., Pointe Claire, Quebec ( * ) Notice: Subject to any disclaimer, the term of this patent is extended or adjusted under 35 U.S.C. 154(b) by 143 days.

(21) Appl. No.: 12/688,281

(22) Filed: Jan. 15, 2010

(65) Prior Publication Data

US 2011/0177768 A1 Jul. 21, 2011

(51) Int. Cl.
*B24B 55/00* (2006.01)

(52) U.S. Cl. ..... 451/466; 451/449

(58) Field of Classification Search ..... 451/449, 451/450, 488, 464–469, 508, 548
See application file for complete search history.

(56) References Cited

U.S. PATENT DOCUMENTS

| | | | | | |
|---|---|---|---|---|---|
| 1,998,783 | A | | 11/1933 | Leach et al. | |
| 2,307,312 | A | * | 1/1943 | Whiting | 451/548 |
| 2,599,952 | A | | 6/1951 | Strayer | |
| 2,942,387 | A | * | 6/1960 | Lindblad | 451/548 |
| 3,161,995 | A | * | 12/1964 | Lindblad | 451/548 |
| 3,290,834 | A | * | 12/1966 | Lindblad | 451/541 |
| 3,574,975 | A | | 4/1971 | Liss | |
| 3,800,483 | A | * | 4/1974 | Sherman | 451/508 |
| 3,872,630 | A | * | 3/1975 | Ali | 451/468 |
| 4,365,448 | A | | 12/1982 | Wilson | |
| D463,965 | S | | 10/2002 | Lee et al. | |
| D466,912 | S | | 12/2002 | Lee | |
| 2007/0128996 | A1 | * | 6/2007 | Ficai | 451/548 |

OTHER PUBLICATIONS

Diamond Grinding Wheels and Cup Wheels by Monsoon, http://www.diamond-grinding-wheels.com/products/diamond-grinding-wheels/blower-diamond-grinding-wheels/4-blower-diamond-grinding-wheels-5-8-11-thread.htm (downloaded Jan. 15, 2010 (1 page)).
Diamond cup grinding wheel, China Manufacturer, http://www.tradekorea.com/product-detail/P00229507/diamond_cup_grinding_wheel.html (downloaded Jan. 15, 2010 (3 pages)).
Diamond Grinding Wheel—Large Photo & Picture, http://www.alibaba.com/product-gs/228228203/DIAMOND_GRINDING_WHEEL/showimage.html (downloaded Jan. 15, 2010 (1 page)).
Notice of Allowance issued on Dec. 2, 2010 in connection with U.S. Appl. No. 29/353,903, 8 pages.
Diamond Grinding Wheels and Cup Wheels by Monsson, http://www.diamond-grinding- wheels.com/products/diamond-grinding-wheels/blower-diamond-grinding-wheels/4-blower-diamond-grinding-wheels-5-8-11-thread.htm, copyright 2005.
Diamond cup grinding wheel, China Manufacturer, http://www.tradekorea.com/product-detail/P00229507/diamond_cup_grinding_wheel.html, copyright 2008. Diamond Grinding Wheel—Large Photo & Picture, http://www.alibaba.com/product-gs/228228203/DIAMOND_GRINDING_WHEEL/showimage.html, copyright 1999.

* cited by examiner

*Primary Examiner* — Robert Rose
(74) *Attorney, Agent, or Firm* — Fish & Richardson P.C.

(57) ABSTRACT

The present invention provides an abrasive wheel that comprises a ring-shaped abrasive surface and an integrally formed central portion. The ring-shaped abrasive surface has an outer peripheral edge and an inner peripheral edge. The integrally formed central portion comprises an attachment portion for attaching the abrasive wheel to a rotation source and a plurality of fan blades for directing air-flow over the ring-shaped abrasive surface. The plurality of fan blades are positioned radially inwardly of the inner peripheral edge of the ring-shaped abrasive surface.

32 Claims, 8 Drawing Sheets

ABRASIVE WHEEL COMPRISING A FAN-LIKE STRUCTURE

FIELD OF THE INVENTION

The present invention relates generally to the field of abrasive wheels for cutting, grinding and finishing material surfaces, and more particularly to abrasive wheels that comprise a central portion having a plurality of fan blades for directing air-flow over an abrasive surface of the abrasive wheel.

BACKGROUND

Abrasive wheels for cutting, grinding and performing other finishing operations on material surfaces are known in the art. Such abrasive wheels are generally attached to different types of power tools that provide rotational motion to the abrasive wheel. More specifically, the abrasive wheels are able to be attached to a rotating arbor of a power tool, such that the power tool is able to provide rotation to the abrasive wheel. As such, when the rotating abrasive wheel contacts the surface of a work piece, the rotation of the abrasive wheel is sufficient to cut, grind or otherwise remove material from the work piece.

Many abrasive wheels are suitable for use with hand-held power tools, such as angle grinders. In addition, in many cases, the abrasive wheels are disposable components that are thrown-away once they have become worn out. A deficiency with many existing abrasive wheels is that they are time consuming and cumbersome to attach to the arbor of the power tools. The attachment and removal processes often requires multiple pieces, such as nuts and clamping discs in order to secure the abrasive wheel to the arbor of the power tool. In addition, tools such as wrenches are often needed in order to both attach a new abrasive wheel to the power tool and remove a worn abrasive wheel from the power tool.

As such, when replacing an abrasive wheel, an operator has to be careful not to lose or otherwise misplace the small pieces, such as the nuts, that are required for attaching a new abrasive wheel. The operators must also be certain to have the necessary tools on hand that are needed to remove a worn abrasive wheel and attach a new abrasive wheels. Obviously, this can result in situations where the operator will have to go out of his or her way in order to replace a worn-out grinding wheel.

In addition, during a grinding, cutting or polishing operation, the relatively high rotation speed of the abrasive wheel can cause the work piece to increase in temperature at the location where the abrasive wheel is in contact with the surface of the work piece. This increase in temperature can result in premature wear of the abrasive wheel, deformation of the work piece as well as potential inefficiency in material removal.

Against this background, it can be seen that there is a need in the industry to improve at least some of the deficiencies presented by existing abrasive wheels used with power tools.

SUMMARY OF THE INVENTION

In accordance with a first broad aspect, the present invention provides an abrasive wheel that comprises a ring-shaped abrasive surface and an integrally formed central portion. The ring-shaped abrasive surface has an outer peripheral edge and an inner peripheral edge. The integrally formed central portion comprises an attachment portion for attaching the abrasive wheel to a rotation source and a plurality of fan blades for directing air-flow over the ring-shaped abrasive surface. The plurality of fan blades are positioned radially inwardly of the inner peripheral edge of the ring-shaped abrasive surface.

In accordance with a second broad aspect, the present invention provides an integrally formed backing plate for an abrasive wheel. The backing plate comprises an abrasive surface attachment portion to which an abrasive surface can be attached, an attachment portion for securing the backing plate to a rotation source and a plurality of fan blades positioned between the attachment portion and the abrasive surface attachment portion.

In accordance with a third broad aspect, the present invention provides an abrasive wheel. The abrasive wheel comprises an abrasive disc having an abrasive surface and a depressed center portion and an integrally formed central portion affixed at least partially within the depressed center portion. The integrally formed central portion comprises an attachment portion for attaching the abrasive disc to a rotation source and a plurality of fan blades for directing air-flow over the abrasive surface.

These and other aspects and features of the present invention will now become apparent to those of ordinary skill in the art upon review of the following description of specific embodiments of the invention in conjunction with the accompanying drawings.

It is to be expressly understood that the description and drawings are only for the purpose of illustration of certain embodiments of the invention and are an aid for understanding. They are not intended to be a definition of the limits of the invention.

DETAILED DESCRIPTION

Figure 1:
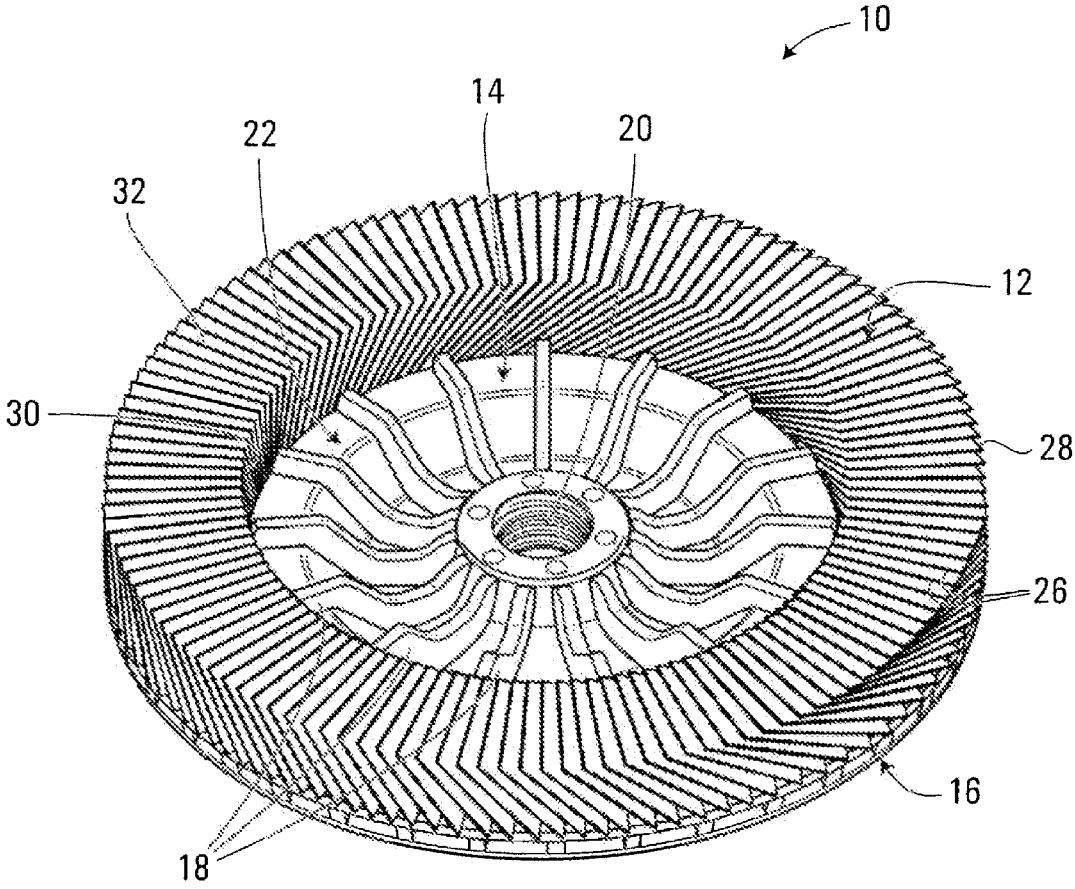
FIG. 1 shows a front perspective view of an abrasive wheel according to a first non-limiting embodiment of the present invention.
Figure 2:
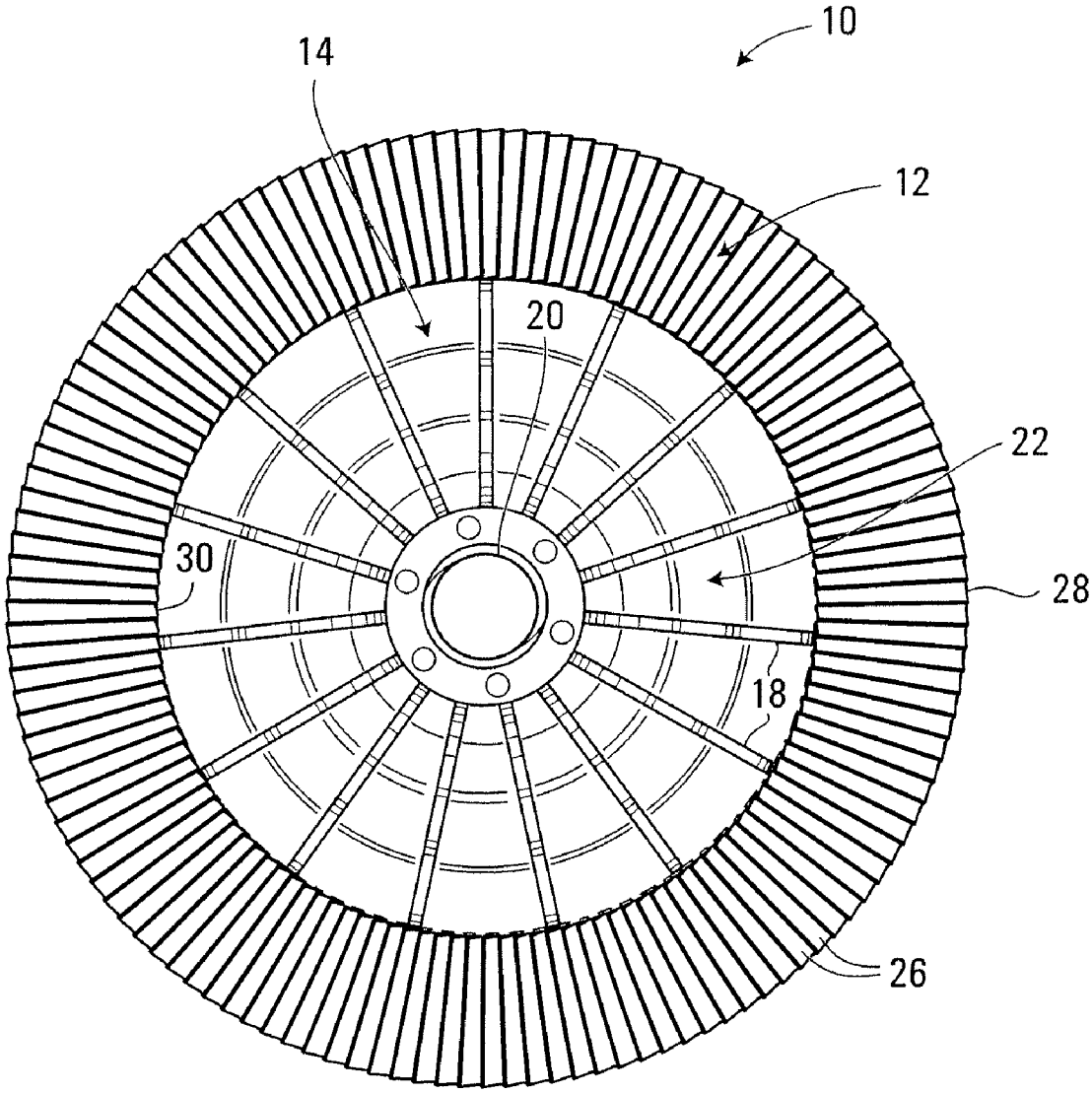
FIG. 2 shows a front plan view of the abrasive wheel of FIG. 1.
Figure 3:
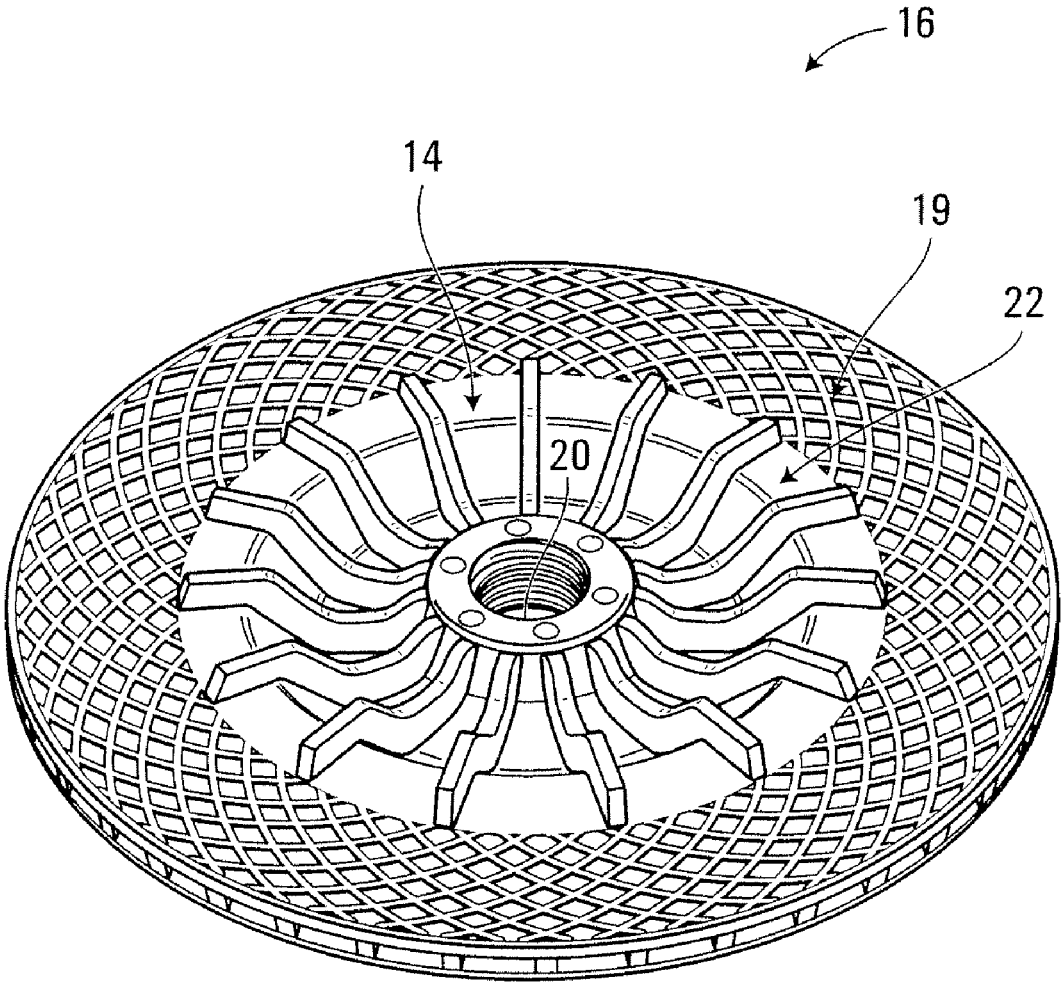
FIG. 3 shows a front perspective view of a backing plate for an abrasive wheel in accordance with a non-limiting embodiment of the present invention.
Figure 4:
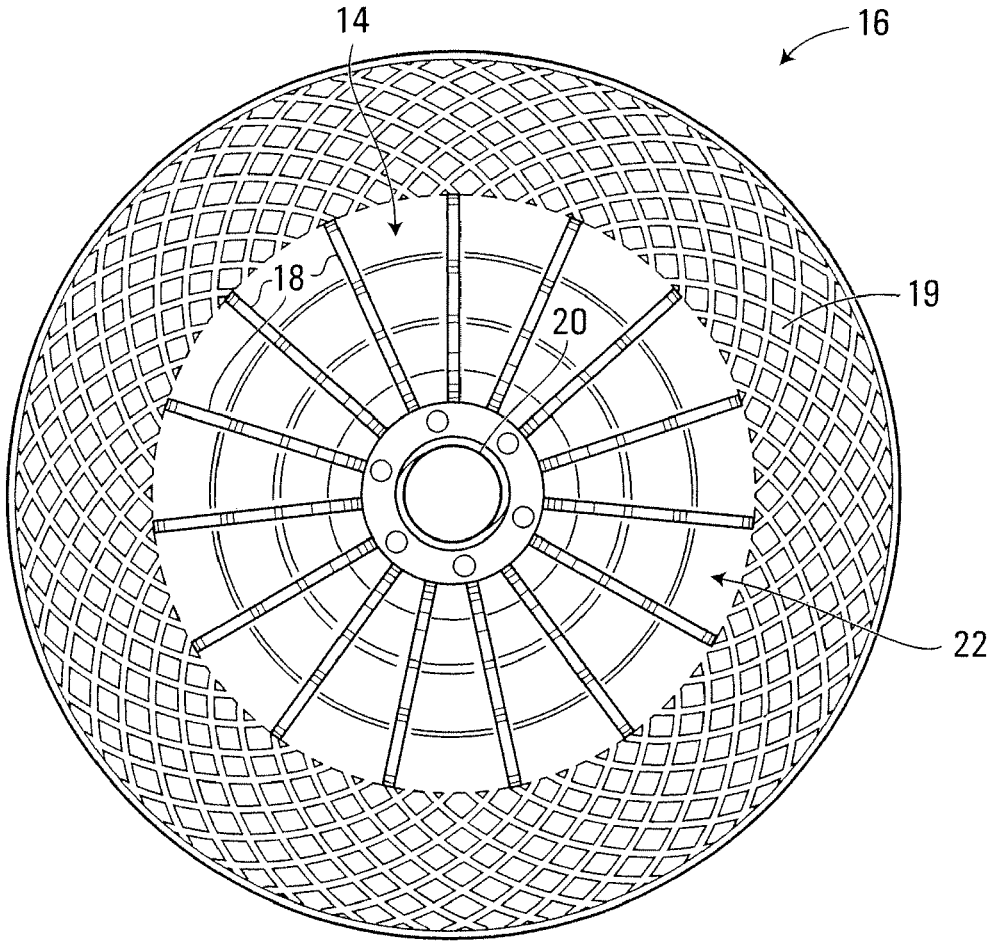
FIG. 4 shows a front plan view of the backing plate of FIG. 3.

Shown in FIGS. 1 and 2 is an abrasive wheel 10 in accordance with a first non-limiting embodiment of the present invention. The abrasive wheel 10 includes a ring-shaped abrasive surface 12 and a central portion 14 that is located radially inwardly of the ring-shaped abrasive surface 12.

In the non-limiting embodiment shown, the central portion 14 is part of a backing plate 16 that can best be seen in FIGS. 3-6. The backing plate 16 comprises the central portion 14 as well as an abrasive surface attachment portion 19 to which the ring-shaped abrasive surface 12 can be attached. The backing plate 16 will be described in more detail further on in the specification.

Referring back to FIGS. 1 and 2, the central portion 14 of the abrasive wheel 10 comprises an attachment portion 20 and a plurality of fan blades 18 that extend radially outwardly from the attachment portion 20 towards the ring-shaped abrasive surface 12. Although the term "fan blade" will be used herein, it should be appreciated that the fan blades 18 can be any air-directing devices that are able to direct the flow of air over the ring-shaped abrasive surface 12.

The attachment portion 20 is suitable for enabling the abrasive wheel 10 to be attached to a rotation source, which will generally be a rotating shaft, such as an arbor or mandrel, of the power tool. For the sake of simplicity, the rotating shaft of the power tool will be referred to as an arbor within the present application.

As such, the attachment portion 20 can be a threaded hole, such that the abrasive wheel can be screwed directly onto a threaded arbor of the power tool. This can be done without the need for an additional nut, and in most cases, without the need for any additional tools, such as a wrench. The threaded attachment portion 20 may allow a user to securely screw the abrasive wheel 10 onto the arbor of the power tool using only his or her hands. The pitch of the threads and the helix of the threads that are included within the threaded hole of the attachment portion 20 are selected such that, during use, the abrasive wheel 10 has minimal linear movement along the arbor and is unable to become unscrewed.

In an alternative embodiment, the attachment portion 20 can be an un-threaded cylindrical hole that is able to slide onto the arbor of the power tool, such that the abrasive wheel 10 is then secured to the arbor by using a separate nut.

Once the abrasive wheel 10 has been attached to the arbor of a power tool (not shown), the arbor can be caused to rotate by either an electric motor, a petrol engine or compressed air, depending on the type of power tool being used. The rotation of the arbor thus causes rotational motion to be imparted to the abrasive wheel 10.

It should be appreciated that different types and sizes of abrasive wheels 10 may need to be attached to different sizes of arbors or mandrels. For example, larger abrasive wheels may need to be attached to power tools having larger arbors. As such, the diameter of the attachment portion 20 may be different for different types and sizes of abrasive wheels 10, so as to enable the different types and sizes of abrasive wheels 10 to be attached to different sizes of arbors or mandrels. In accordance with a non-limiting example, the diameters of the attachment portions may be between ¼" to ⅞" or 6.0 mm to 22.2 mm. However, the present invention is not limited by the diameter of the attachment portion 20.

Figure 5:
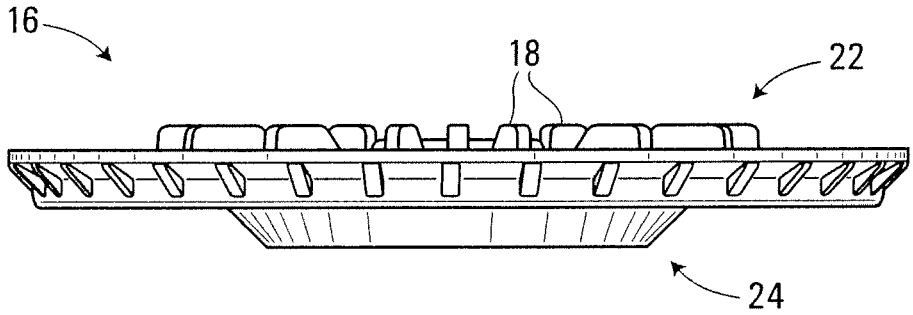
FIG. 5 shows a side plan view of the backing plate of FIG. 3.
Figure 6:
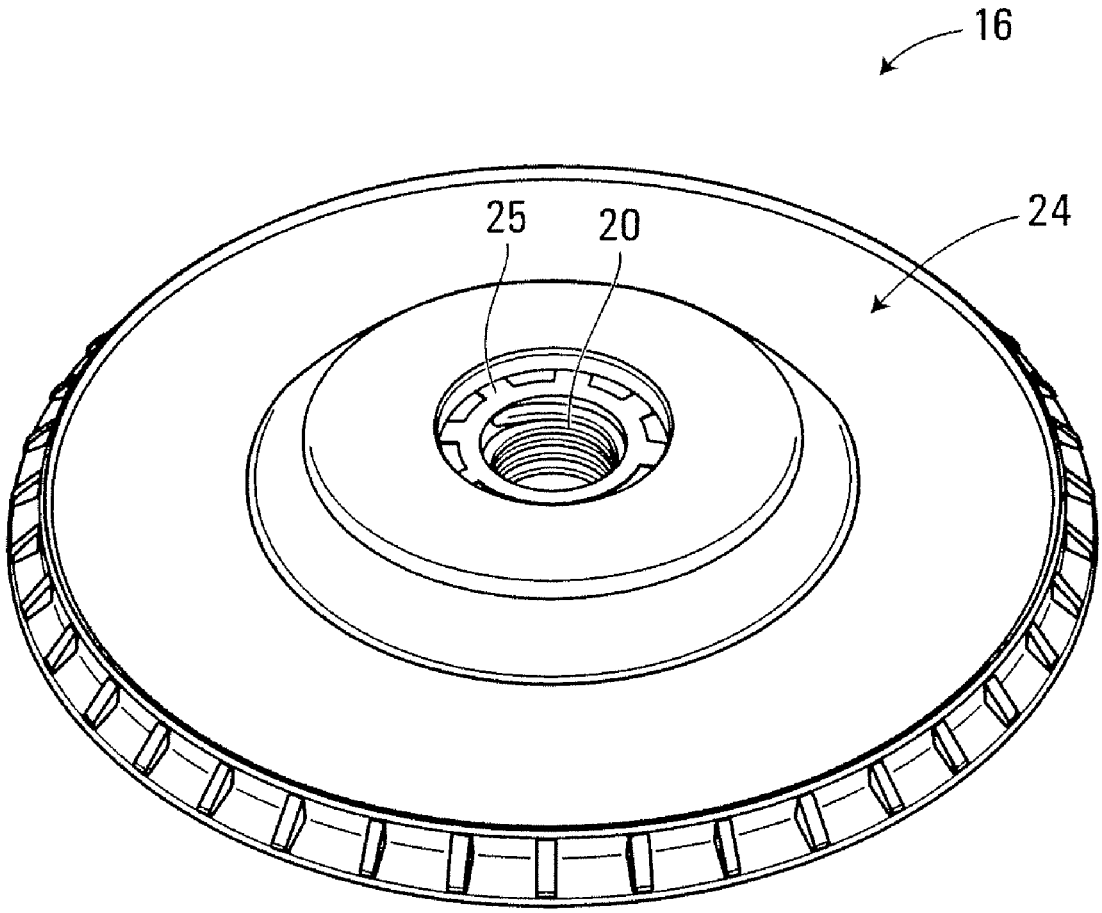
FIG. 6 shows a back perspective view of the backing plate of FIG. 3.

The central portion 14 of the abrasive wheel 10 further comprises a front surface 22 (shown in FIGS. 1, 2 and 3) and a back surface 24 (shown in FIGS. 5 and 6). The front surface 22 faces towards the abrasive surface 12 and the back surface 24 faces towards the power tool (not shown). The plurality of fan blades 18 are positioned on the front surface 22 of the central portion 14, such that they are able to direct air-flow over the ring-shaped abrasive surface 12 when in use. This will be described in more detail further on in the specification.

In the non-limiting embodiment shown, the central portion 14 comprises fifteen fan blades 18 that are each separated by 24 degrees. It should, however, be appreciated that the central portion 14 may comprise any number of fan blades 18, so long as the number of fan blades 18 is suitable for achieving a desired air-flow over the abrasive surface 12. The separation between the fan blades 18 will vary depending on the number of fan blades included within the central portion 14.

As shown in FIGS. 1 and 2, the fan blades 18 are radial fan blades that extend radially in a strait line from the attachment portion 20 towards the abrasive surface. In alternative embodiments, the fan blades 18 may also be curved fan blades that have either a forward curve or a backward curve.

Furthermore, when viewed from the side, the fan blades 18 have a spoon-shaped side profile. As can be seen in FIG. 1, the front surface 22 of the central portion 14 includes a half-torus shaped recess between the attachment portion 20 and the tips of the fan blades 18. As the fan blades 18 extend radially from the attachment portion 20 to the abrasive surface 12, the fan blades 18 dip down into the half-torus shaped recess and then extend out of the torus-shaped recess towards the abrasive surface 12. It is this dip into the half-torus shaped recess that gives the fan blades 18 the spoon-shaped side profile. It should be appreciated that in alternative embodiments, the fan blades 18 can have any shaped side profile that provides a desired amount of air-flow over the abrasive surface 12.

During use, the plurality of fan blades 18 are operative for directing air-flow over the ring-shaped abrasive surface 12. More specifically, the plurality of fan blades 18 create a type of centrifugal fan-like structure that is able to take air from the ambient environment and direct that air over the ring-shaped abrasive surface 12.

In the embodiment shown in the Figures, the central portion 14 is closed to the passage of air from the front surface 22 to the back surface 24. More specifically, there are no holes or other apertures between the fan blades 18 that would allow air to pass through the central portion 14 from the front surface 22 to the back surface 24. Instead, the air that is sucked-in from the ambient environment is displaced towards the sides of the abrasive wheel 10, such that there is an increase in the flow of air over the abrasive surface 12.

This increase in the air-flow over the abrasive surface 12 causes the temperature increase at the region where the abrasive surface 12 contacts the work piece to be less than it would be in the case where the abrasive wheel does not include any fan blades 18. By limiting/reducing the increase in temperature at the surface of the work piece, there can be an increase in the efficiency of material removal, less wear on the abrasive wheel 10 and less likelihood of any deformation to the work piece.

In accordance with a non limiting example, the abrasive wheel 10 that includes the plurality of fan blades 18 causes the increase in temperature at the surface of a work piece to be at least 8-10% less in comparison to the same abrasive wheel that does not include the fan blades. The abrasive wheel 10 has also been found to be able to increase the material removal rate on a work piece by between approximately 17% in comparison to the same abrasive wheel that does not include the fan blades. Furthermore, it has been found that the abrasive wheel 10 that includes the plurality of fan blades 18 experiences less wear than the same abrasive wheel 10 without the fan blades. In a non-limiting example, the ratio of material removal to wear in grams has been found to be 60.1:1 for the abrasive wheel 10, in comparison to a ratio of 36.4:1 for the same abrasive wheel that does not include the fan blades.

In the non-limiting embodiment shown in FIGS. 1 and 2, the ring-shaped abrasive surface 12 of the abrasive wheel 10 is formed from a plurality of overlapping abrasive flaps 26 that are positioned on the abrasive surface attachment portion 19 of the backing plate 16. The overlapping abrasive flaps 26 can be formed from any suitable abrasive material, such as abrasive cloth, fiber, paper or a non-woven material with an aluminum oxide, zirconium, ceramic, silicone carbide or diamond abrasive grain. The overlapping abrasive flaps 26 can be attached to the abrasive surface attachment portion 19 of the backing plate 16 via any suitable adhering substance, such as glue or epoxy. In accordance with a non-limiting example, the adhering substance may be thermosetting epoxy resin. It should be appreciated that other methods of securing the overlapping flaps 26 to the abrasive surface attachment portion 19 are also included within the scope of the present invention.

When positioned on the abrasive surface attachment portion 19, the ring-shaped abrasive surface 12 comprises an outer peripheral edge 28 and an inner peripheral edge 30. In the non-limiting embodiment shown, the plurality of fan blades 18 are positioned radially inwardly of the inner peripheral edge 30 of the ring-shaped abrasive surface 12. Furthermore, the central portion 14 of the abrasive wheel 10 is recessed in relation to the plane created by the top surface 32 of the abrasive surface 12. In this manner, the fan blades 18 of the central portion 14 do not protrude and interfere, or otherwise get in the way, when the abrasive wheel 10 is in use.

The abrasive wheel 10 described above with respect to FIGS. 1 and 2 may commonly be referred to as a flap disc. Flap discs can be suitable for finishing and/or grinding metal work pieces.

Shown in FIGS. 3, 4, 5 and 6 are different views of the backing plate 16 that is part of the abrasive wheel 10. As previously mentioned, the backing plate 16 comprises the abrasive surface attachment portion 19 and a central portion 14 that includes the attachment portion 20 and the plurality of fan blades 18. In accordance with the present invention, at least the central portion 14 is integrally formed, such that the attachment portion 20 and the plurality of fan blades 18 are formed as a single component that is made of the same material. In some embodiments, the central portion 14 may be formed via a molding process, such as injection molding, or by thermoforming or stamping, among other possibilities. In a further embodiment, the attachment portion 20 can be welded or heat bonded to the plurality of fan blades 18 (including the solid web portions between the fan blades) such that once connected together, the attachment portion 20 and the plurality of fan blades 18 of the central portion 14 are integrally formed. In a further embodiment, the abrasive surface attachment portion 19 is also integrally formed with the central portion 14, such that the entire backing plate 16 is an integrally formed unit. For example, the entire backing plate 16 may be formed via a molding process. The central portion 14 and/or the entire backing plate 16 can be made of any suitable material, such as a plastic material (including ABS, PE, PET and Polypropylene). The central portion 14 could also be made of aluminum, zinc or a fiberglass composite material, among other possibilities. In accordance with a non-limiting example, the central portion 14 can be made of a Polyamide 6 plastic with 20 to 40% fiberglass reinforcement.

Shown in FIG. 6 is a back surface 24 of the backing plate 16. The attachment portion 20 comprises a circular recess 25 that has a diameter greater than the diameter of the threaded hole. The recess 25 is suitable for receiving a centering step commonly found on backing flanges supplied with power tools.

Figure 7:
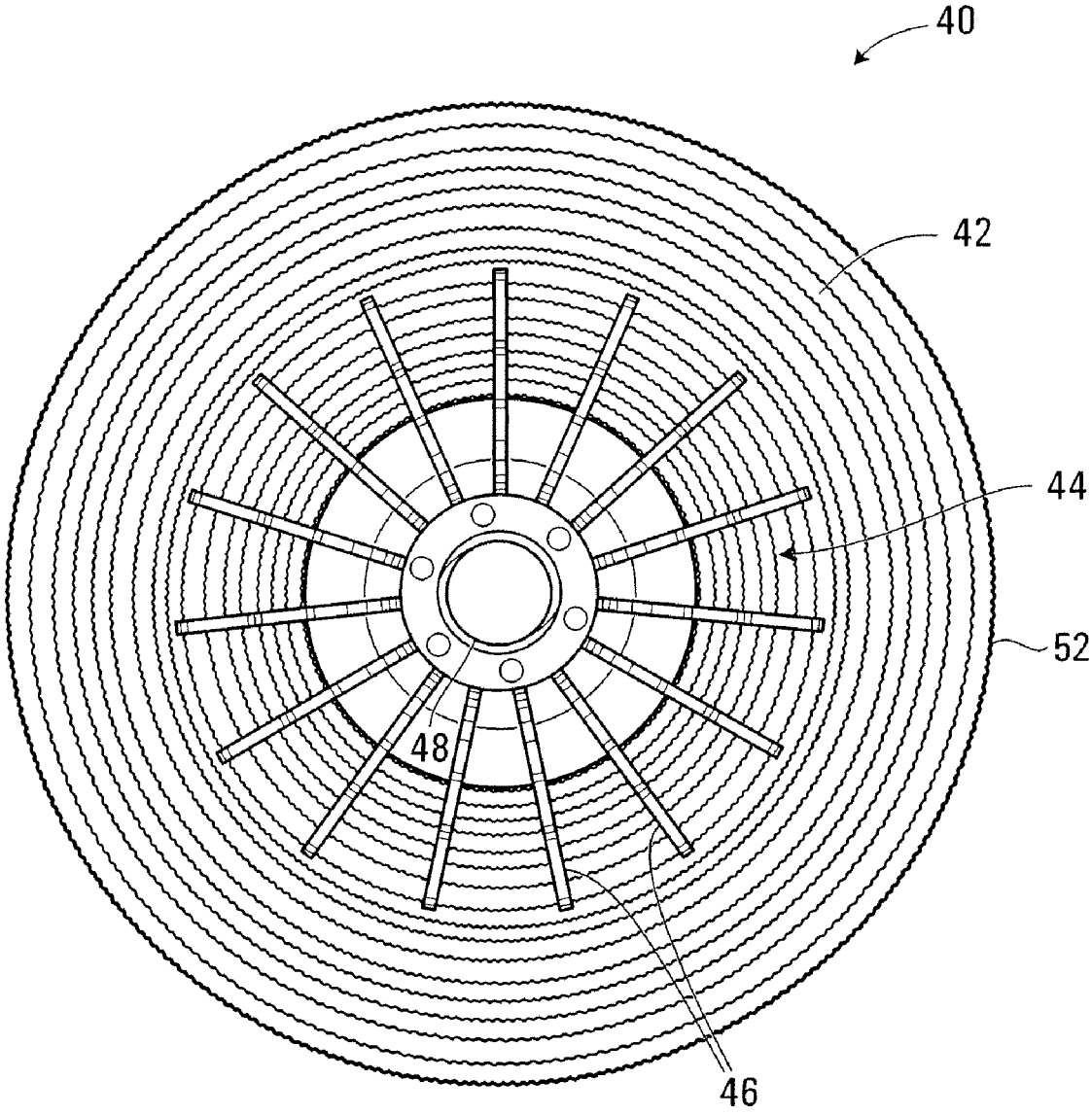
FIG. 7 shows a front plan view of an abrasive wheel according to a second non-limiting embodiment of the present invention.
Figure 8:
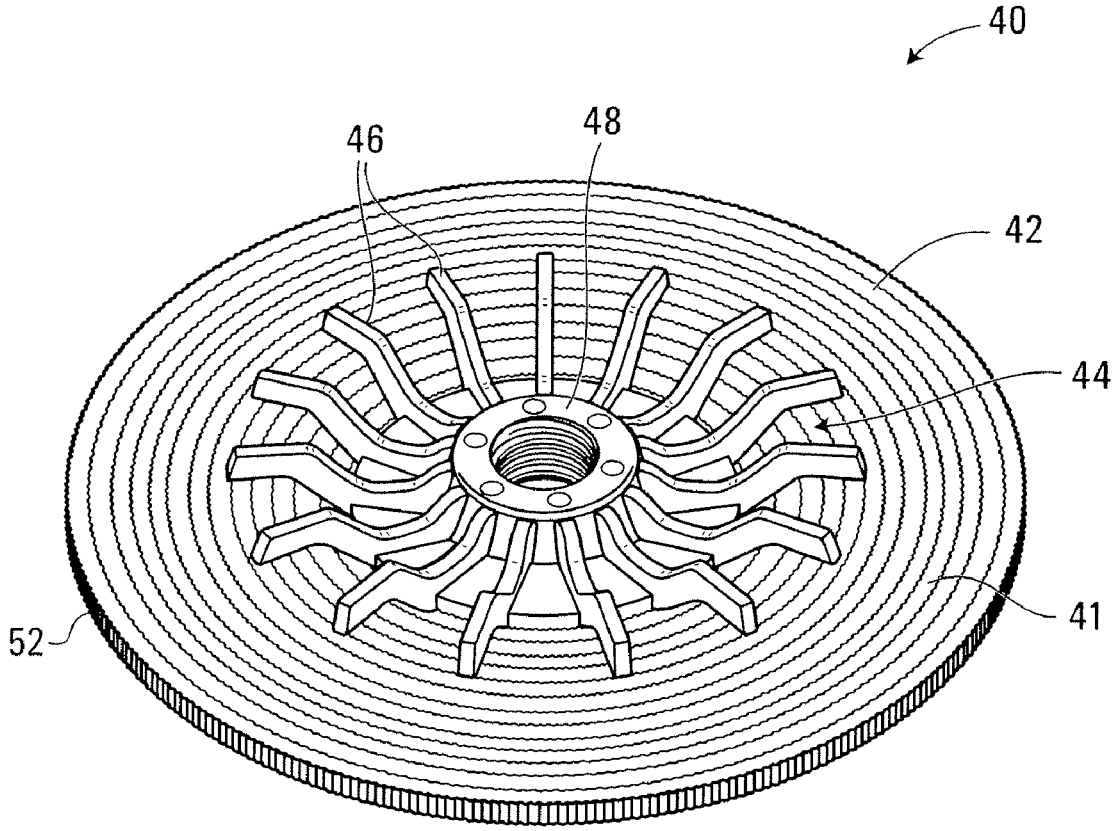
FIG. 8 shows a front perspective view of the abrasive wheel of FIG. 7.
Figure 9:
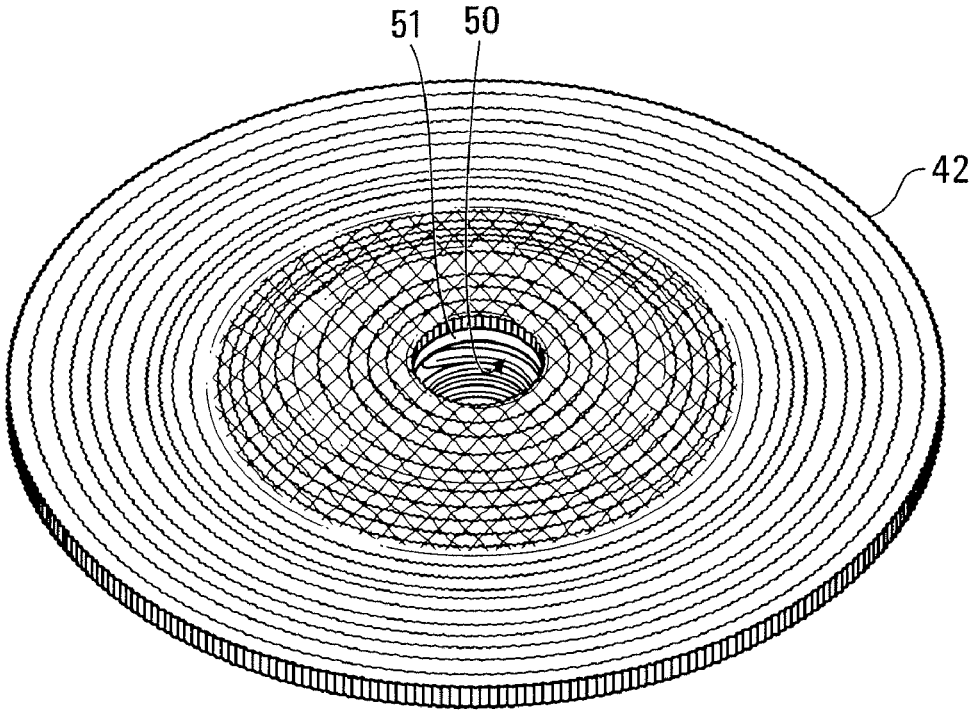
FIG. 9 shows a back perspective view of the abrasive wheel of FIG. 7.
Figure 10:
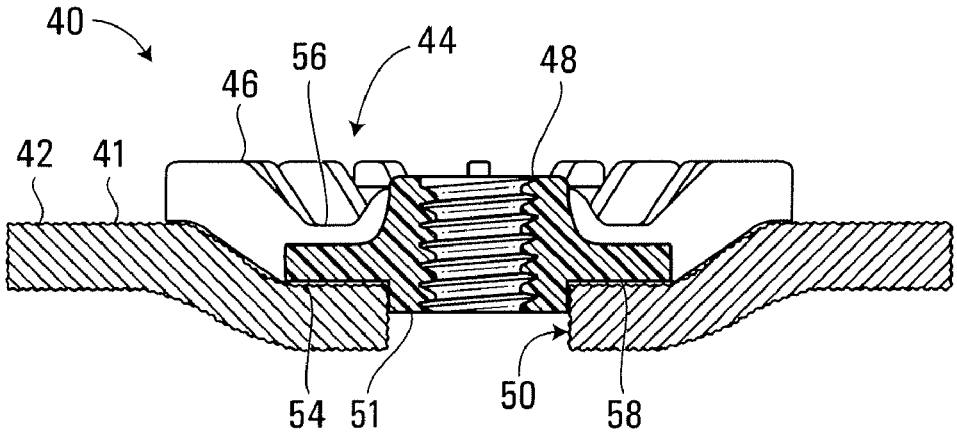
FIG. 10 shows a cross-sectional view of the abrasive wheel of FIG. 7.

Shown in FIGS. 7, 8 and 9 is an abrasive wheel 40 in accordance with a second non-limiting embodiment of the present invention. The abrasive wheel 40 includes an abrasive disc 42 and a central portion 44 that is affixed to the abrasive disc 42. FIG. 10 shows a cross sectional view of the abrasive wheel 40. As shown, the abrasive wheel 40 includes a depressed center portion 54. The central portion 44, which is made from a different material than the abrasive disc 42, is affixed, at least partially, within the depressed center portion 54. In this manner, although the central portion 44 extends above the grinding plane 41 of the abrasive disc, the central portion 44 does not sufficiently protrude to interfere or otherwise get in the way of the grinding operation.

The abrasive disc 42 can be made of any suitable abrasive material such as phenolic resin or reinforced fiberglass with an abrasive grain of aluminum oxide, zirconium, ceramic, silicon carbide, among other possibilities.

The central portion 44 is similar to the central portion 14 described above with respect to abrasive wheel 10. More specifically, the center portion 44 comprises an attachment portion 48 and a plurality of fan blades 46 that extend radially outwardly from the attachment portion 48.

The attachment portion 48 is suitable for enabling the abrasive wheel 40 to be attached to an arbor or mandrel of a power tool. The attachment portion 40 can be a threaded hole, such that the abrasive wheel can be screwed directly onto a threaded arbor of the power tool without the need for an additional nut, and in most cases, without the need for any additional tools. The threaded attachment portion 48 may thus allow a user to securely screw the abrasive wheel 40 onto the arbor of the power tool using only his or her hands. The pitch of the threads and the helix of the threads are selected such that, during use, the abrasive wheel 40 has minimal linear movement along the arbor and is unable to become unscrewed.

In an alternative embodiment, the attachment portion 48 can be an un-threaded cylindrical hole that is able to slide onto the threaded arbor, such that the abrasive wheel 40 can then be secured to the arbor with a separate nut.

It should be appreciated that the diameter of the attachment portion 48 may be different for different types and sizes of abrasive wheels 40, so as to enable different abrasive wheels 40 to be attached to different sizes of arbors for different power tools. The present invention is not limited by the diameter of the attachment portion 48.

The central portion 44 of the abrasive wheel 40 comprises a front surface 56 (shown in FIGS. 8 and 10) and a back surface 58 (shown in FIG. 10). The front surface 56 faces outwardly towards a work-piece, when in use, while the back surface 58 faces towards the depressed center 54 of the abrasive disc 42. As will be described in more detail below, the back surface 58 of the central portion 44 will be adhered, or otherwise secured, to the depressed center of the abrasive disc 42.

The plurality of fan blades 46 are positioned on the front surface 56 of the central portion, such that they are able to direct air-flow over the grinding plane 41 of the abrasive disc, when in use. In the non-limiting embodiment shown, the central portion 44 comprises fifteen fan blades 46 that are each separated by 24 degrees. It should, however, be appreciated that the central portion 14 may comprise any number of fan blades 46, so long as the number of fan blades 46 is suitable for achieving a desired air-flow over the grinding plane 41 of the abrasive disc 42. The separation between the fan blades 46 will vary depending on the number of fan blades included within the central portion 44.

In the embodiment shown, the fan blades 46 are radial fan blades that extend radially in a strait line from the attachment portion 48 towards the grinding plane 41 of the abrasive disc. In alternative embodiments, the fan blades 18 may also be curved fan blades that have either a forward curve or a backward curve.

In the same manner as described above with respect to fan blades 18, when viewed from the side, the fan blades 46 have a spoon-shaped side profile, and the front surface 56 of the central portion 44 includes a half-torus shaped recess between the attachment portion 48 and the tips of the fan blades 46. It should be appreciated that in alternative embodiments, the fan blades 46 can have any shaped side profile that provides a desired amount of air-flow over the grinding plane 41 of the abrasive disc 42.

During use, the plurality of fan blades 46 are operative for directing air-flow over the grinding plane 41 of the abrasive disc 42. More specifically, the plurality of fan blades 46 create a type of centrifugal fan-like structure that is able to take air from the ambient environment and direct that air over the grinding plane 41 of the abrasive disc 42.

Given that the back surface 58 of the central portion 44 is affixed to the depressed center 54 of the abrasive disc 42, the central portion 44 is closed to the passage of air from the front surface 56 to the back surface 58, as well as to the back surface of the abrasive wheel 40. In this manner, the air that is sucked-in by the fan blades 46 from the ambient environment is directed towards the sides of the abrasive wheel 40, such that there is an increase in the air movement over the grinding plane 41 of the abrasive disc 42.

This increase in air-flow causes the temperature increase at the region where the abrasive surface 42 contacts the work piece to be less than it would be in the case where the abrasive wheel does not include any fan blades 46.

In accordance with a non limiting example, the abrasive wheel 40 that includes the plurality of fan blades 46 causes the increase in temperature at the surface of a work piece to be at least 5-7.5% less in comparison to the same abrasive wheel that does not include the fan blades. The abrasive wheel 40 has also been found to be able to increase the material removal rate on a work piece by between approximately 10% in comparison to the same abrasive wheel that does not include the fan blades. Furthermore, it has been found that the abrasive wheel 40 that includes the plurality of fan blades 46 experiences less wear than the same abrasive wheel 40 without the fan blades. In a non-limiting example, the ratio of material removal to wear in grams has been found to be 11.9:1 for the abrasive wheel 40, in comparison to a ratio of 11.2:1 for the same abrasive wheel that does not include the fan blades.

The abrasive disc 42 includes an outer peripheral edge 52 and a depressed center portion 54 that has, at its center, a central hole 50 (shown in FIGS. 9 and 10). The central portion 44 is affixed at least partially within the depressed center portion 54 of the abrasive disc 42, such that the central portion 44 is centered in relation to the abrasive disc 42. The centering of the central portion 44 in relation to the abrasive disc 42 is done by positioning a step 51 that is part of the central portion 44 within the central hole 50 of the abrasive disc 42.

The central portion 44 can be affixed within the depressed center portion 54 of the abrasive disc 42 in a variety of different manners. For example, the central portion 44 can be adhered to the abrasive disc 42 via adhesive or epoxy, such as cyanoacrylate. However, other methods, such as crimping or welding may also be used.

In accordance with the present invention, the central portion 44 is integrally formed, such that the attachment portion 48 and the plurality of fan blades 46 are formed as a single component that is made of the same material. For example, the central portion 44 may be made via a molding process, such as injection molding or via a thermoforming or stamping process, among other possibilities. In a further embodiment, the attachment portion 48 can be welded or heat bonded to the plurality of fan blades 46 (including the solid web portions between the fan blades) such that once connected together, the attachment portion 48 and the plurality of fan blades 46 of the central portion 44 are integrally formed. The central portion 44 can be made of any suitable material, such as a plastic material, aluminum, zinc or a fiberglass composite material, among other possibilities.

The abrasive wheel 40 described above with respect to FIGS. 7-10 may commonly be referred to as a grinding disc that is suitable for cutting and/or grinding metal work pieces While specific embodiments of the present invention have been described and illustrated, it will be apparent to those skilled in the art that numerous modifications and variations can be made without departing from the scope of the invention as defined in the appended claims.

What is claimed is:

1. An abrasive wheel, comprising:

a. a ring-shaped abrasive surface having an outer peripheral edge and an inner peripheral edge, the ring-shaped abrasive surface being defined by a plurality of overlapping abrasive flaps;

b. an integrally formed central portion, comprising:

i. a threaded attachment portion for attaching the abrasive wheel to a rotation source;

ii. a plurality of fan blades for directing air-flow over the ring-shaped abrasive surface, the plurality of fan blades being positioned radially inwardly of the inner peripheral edge of the ring-shaped abrasive surface.

2. An abrasive wheel as defined in claim 1, wherein a ratio of material removal to wear of the abrasive wheel in grams is between 55:1 and 65:1.

3. An abrasive wheel as defined in claim 1, wherein the integrally formed central portion comprises a front surface and a back surface, wherein the fan blades are positioned on the front surface.

4. An abrasive wheel as defined in claim 3, wherein the integrally formed central portion is closed to the passage of air from the front surface to the back surface.

5. An abrasive wheel as defined in claim 1, wherein front surface of the integrally formed central portion includes a half-torus shaped recess.

6. An abrasive wheel as defined in claim 5, wherein the threaded attachment portion is positioned at the center of the half-torus shaped recess.

7. An abrasive wheel as defined in claim 1, wherein the integrally formed central portion is formed of a plastic material.

8. An abrasive wheel as defined in claim 7, wherein the integrally formed central portion is formed via a molding process.

9. An abrasive wheel as defined in claim 1, wherein the plurality of fan blades are radial fan blades.

10. An abrasive wheel as defined in claim 1, wherein each of the plurality of fan blades has a spoon-shaped side profile.

11. An abrasive wheel as defined in claim 1, wherein the integrally formed central portion is part of a backing plate, the backing plate further comprises an abrasive surface supporting portion to which the ring-shaped abrasive surface is secured.

12. An abrasive wheel, comprising:

a. a ring-shaped abrasive surface having an outer peripheral edge and an inner peripheral edge;

b. an integrally formed central portion comprising:

i. a front surface and a back surface;

ii. a threaded attachment portion for attaching the abrasive disc to a rotation source; and iii. a plurality of fan blades located on the front surface for directing air-flow over the abrasive surface, wherein the plurality of fan blades extend radially from the attachment portion to the ring shaped abrasive surface and are spaced evenly around the attachment portion, the central portion being closed to the passage of air from the front surface to the back surface such that the plurality of fan blades displace air over the abrasive surface.

13. An abrasive wheel as described in claim 12, wherein the plurality of fan blades comprises at least eleven fan blades.

14. An abrasive wheel as described in claim 12, wherein the central portion has a depressed center portion.

15. An abrasive wheel as described in claim 12, wherein the plurality of fan blades have a substantially uniform thickness.

16. An abrasive wheel as defined in claim 1, wherein the plurality of overlapping abrasive flaps comprise at least one of abrasive cloth, fiber, paper and a non-woven material with aluminum oxide, zirconium, ceramic, silicone carbide or diamond abrasive grain.

17. An integrally formed backing plate for an abrasive wheel, comprising:

a. a front surface and a back surface;

b. an abrasive surface attachment portion on the front surface, to which an abrasive surface can be attached;

c. a threaded attachment portion for securing the backing plate to a rotation source;

d. a plurality of fan blades positioned on the front surface between the threaded attachment portion and the abrasive surface attachment portion, for directing air-flow over an abrasive surface attached to the abrasive surface attachment portion; and e. a central portion extending between the threaded attachment portion and the abrasive surface attachment portion, the plurality of fan blades being positioned on the central portion, wherein the central portion is closed to the passage of air from the front surface to the back surface.

18. An integrally formed backing plate as defined in claim 17, wherein the integrally formed backing plate is formed of at least one of a plastic material, aluminum and zinc.

19. An integrally formed backing plate as defined in claim 18, wherein the integrally formed backing plate is formed via a molding process.

20. An integrally formed backing plate as defined in claim 17, wherein the plurality of fan blades are radial fan blades.

21. An abrasive wheel, comprising:

a. an abrasive disc having an abrasive surface and a depressed center portion;

b. an integrally formed central portion affixed at least partially within the depressed center portion, the integrally formed central portion comprising:

i. an attachment portion for attaching the abrasive disc to a rotation source;

ii. a plurality of fan blades defining a spoon-shaped side profile for directing air-flow over the abrasive surface.

22. An abrasive wheel as defined in claim 21, wherein the attachment portion comprises a threaded hole.

23. An abrasive wheel as defined in claim 21, wherein the integrally formed central portion comprises a front surface and a back surface, wherein the fan blades are positioned on the front surface.

24. An abrasive wheel as defined in claim 23, wherein the integrally formed central portion is closed to the passage of air from the front surface to the back surface.

25. An abrasive wheel as defined in claim 23, wherein the front surface of the integrally formed central portion includes a half-torus shaped recess.

26. An abrasive wheel as defined in claim 25, wherein the attachment portion is positioned at the center of the half-torus shaped recess.

27. An abrasive wheel as defined in claim 23, wherein the integrally formed central portion is formed of at least one of plastic material, aluminum and zinc.

28. An abrasive wheel as defined in claim 27, wherein the integrally formed central portion is formed via a molding process.

29. An abrasive wheel as defined in claim 23, wherein the plurality of fan blades are radial fan blades.

30. An abrasive wheel as defined in claim 23, wherein the abrasive wheel is a grinding disc.

31. An abrasive wheel as defined in claim 23, wherein the abrasive disc is formed of at least one of phenolic resin and reinforced fiberglass with an abrasive grain comprising at least one of aluminum oxide, zirconium, ceramic and silicone carbide.

32. An abrasive wheel as described in claim 12, wherein each of the plurality of fan blades defines a spoon-shaped side profile.

* * * * *

UNITED STATES PATENT AND TRADEMARK OFFICE

CERTIFICATE OF CORRECTION

PATENT NO. : 8,246,425 B2
APPLICATION NO. : 12/688281
DATED : August 21, 2012
INVENTOR(S) : Werner Schudel It is certified that error appears in the above-identified patent and that said Letters Patent is hereby corrected as shown below:

First page, Col. 2 (Other Publications), Line 13, Delete "Monsson," and insert --Monsoon,--, therefor.

In Claim 16, Col. 9, Line 16, delete "silicone" and insert --silicon--, therefor.

In Claim 36, Col. 19, Line 38, delete "silicone" and insert --silicon--, therefor.

Signed and Sealed this
Twentieth Day of November, 2012

David J. Kappos

David J. Kappos
*Director of the United States Patent and Trademark Office*